US007819725B2

(12) United States Patent
Hagiwara et al.

(10) Patent No.: US 7,819,725 B2
(45) Date of Patent: Oct. 26, 2010

(54) SANDER

(75) Inventors: Hirokazu Hagiwara, Aichi (JP); Hiroshi Nojiri, Aichi (JP)

(73) Assignee: Makita Corporation, Anjo-shi (JP)

( * ) Notice: Subject to any disclaimer, the term of this patent is extended or adjusted under 35 U.S.C. 154(b) by 577 days.

(21) Appl. No.: 11/896,052

(22) Filed: Aug. 29, 2007

(65) Prior Publication Data

US 2008/0057841 A1 Mar. 6, 2008

(30) Foreign Application Priority Data

Aug. 31, 2006 (JP) ..... 2006-236079

(51) Int. Cl.
*B24B 23/00* (2006.01)

(52) U.S. Cl. ..... 451/356; 451/354; 451/357

(58) Field of Classification Search ..... 451/344, 451/354, 356, 357
See application file for complete search history.

(56) References Cited

U.S. PATENT DOCUMENTS

| | | | | |
|---|---|---|---|---|
| 3,336,702 | A * | 8/1967 | Enders | 451/356 |
| 3,418,761 | A * | 12/1968 | Sheps | 451/356 |
| 3,849,943 | A * | 11/1974 | Thomas et al. | 451/357 |
| 4,686,797 | A | 8/1987 | Hoffman | |
| 4,821,357 | A * | 4/1989 | Millette | 15/93.1 |
| 6,039,639 | A * | 3/2000 | Pfaundler | 451/356 |
| 6,447,383 | B2 * | 9/2002 | Oda et al. | 451/357 |
| 7,056,199 | B2 * | 6/2006 | Valentini | 451/357 |
| 2001/0003087 | A1 | 6/2001 | Oda et al. | |
| 2004/0166786 | A1 * | 8/2004 | Valentini | 451/270 |

FOREIGN PATENT DOCUMENTS

| | | |
|---|---|---|
| CN | 1133219 A | 10/1996 |
| GB | 814793 A | 6/1959 |
| JP | U 51-003988 | 2/1976 |
| JP | B2 3634995 | 1/2005 |

* cited by examiner

*Primary Examiner*—Timothy V Eley
(74) *Attorney, Agent, or Firm*—Oliff & Berridge, PLC

(57) ABSTRACT

A motor is disposed in a main body and has a rotary shaft. A base is disposed below the main body. The base is coupled to the rotary shaft and adapted to make eccentric motions in accordance with rotations of the rotary shaft. A first receptacle is disposed in the main body. A second receptacle is disposed in the base. A foot is disposed between the first receptacle and the second receptacle. The foot includes a foot body made of metal, and elastic members provided on both ends of the foot body and respectively fitted into the first receptacle and the second receptacle, so that the foot body is pivotably supported between the first receptacle and the second receptacle. An elastic sleeve is fitted onto a part of an outer periphery of the foot body while being compressed by the first receptacle and the second receptacle.

8 Claims, 2 Drawing Sheets

SANDER

BACKGROUND

The present invention relates to a sander including a main body provided with a motor, and a base which is disposed below the main body and makes orbital motion according to rotation of the motor.

In a sander, an output shaft is projected to the lower side of the main body having a motor, and the base is eccentrically joined to the output shaft to cause the base to make an orbital motion (eccentric motion) according to rotation of the output shaft in response to driving of the motor, and an object material can be sanded with a sanding paper stretched on the bottom surface of the base. Between the main body and the base, to prevent vibrations (in particular, vertical flopping) according to rotation restriction and orbital motion of the base, receptacles are formed on the main body and the base, respectively, so as to face each other, and between the receptacles, feet are laid. The feet are integrally molded from an elastic material such as rubber in many cases, however, its durability lowers due to heating and wearing. In order to solve this problem, Japanese Patent No. 3634995 discloses a foot including a metallic foot body and elastic members (for example, an O-ring). The elastic members are disposed in the receptacles to support upper and lower ends in the axial direction of the foot body.

On the other hand, when such a foot is used, dust enters the gap, etc., between the receptacle and the O-ring and may wear the O-ring, foot, and receptacle. In order to solve this problem, Japanese Utility Model Publication No. 51-3988U teaches to provide a flexible dustproof cover so as to cover the entire region for providing the foot between the main body and the base.

However, the above-described dustproof cover is made of a thin flexible material which has almost no rigidity, so that its upper and lower ends must be attached by screws, etc., to the opposing surfaces of the main body and the base, respectively. In addition, if gaps are left on the attaching portions, dust may enter from these portions. Therefore, to maintain the sealing performance of the attaching portions, flat attaching surfaces must be provided on the main body and the base, and this limits the shapes of the main body and the base.

SUMMARY

It is therefore one advantageous aspect of the present invention to provide a sander capable of securing high dust proofness at the foot portions by a simple structure regardless of the shapes of the main body and the base.

According to one aspect of the invention, there is provided a sander, comprising:

- a main body;
- a motor, disposed in the main body and having a rotary shaft;
- a base, disposed below the main body, the base being coupled to the rotary shaft and adapted to make eccentric motions in accordance with rotations of the rotary shaft;
- a first receptacle disposed in the main body;
- a second receptacle disposed in the base;
- a foot, disposed between the first receptacle and the second receptacle, and comprising:
  - a foot body, comprised of metal; and
  - elastic members, provided on both ends of the foot body and respectively fitted into the first receptacle and the second receptacle, so that the foot body is pivotably supported between the first receptacle and the second receptacle; and
- an elastic sleeve, fitted onto a part of an outer periphery of the foot body while being compressed by the first receptacle and the second receptacle.

The elastic sleeve may have a length longer than an interval between a lower edge of the first receptacle and an upper edge of the second receptacle. An upper edge of the elastic sleeve may be in press contact with the lower edge of the first receptacle, and a lower edge of the elastic sleeve may be in press contact with the upper edge of the second receptacle.

The elastic sleeve may be comprised of sponge.

The foot body may be comprised of aluminum.

According to one aspect of the invention, there is provided a sander, comprising:

- a main body;
- a motor, disposed in the main body and having a rotary shaft;
- a base, disposed below the main body, the base being coupled to the rotary shaft and adapted to make eccentric motions in accordance with rotations of the rotary shaft;
- a first receptacle disposed in the main body;
- a second receptacle disposed in the base;
- a foot, disposed between the first receptacle and the second receptacle, and comprising:
  - a foot body, comprised of metal; and
  - elastic members, provided on both ends of the foot body and respectively fitted into the first receptacle and the second receptacle, so that the foot body is pivotably supported between the first receptacle and the second receptacle; and
- an elastic sleeve, surrounding a region in which the foot is provided, while being compressed by a lower surface of the main body and an upper surface of the base.

The elastic sleeve may have a length longer than an interval between the lower surface of the main body and the upper surface of the base. An upper edge of the elastic sleeve may be in press contact with the lower surface of the main body, and a lower edge of the elastic sleeve may be in press contact with the upper surface of the base.

The elastic sleeve may be comprised of sponge.

The foot body may be comprised of aluminum.

With the above configurations, high dust proofness can be attained at the foot, so that the foot body and the receptacles can be prevented from being worn by dust. In addition, this effect can be obtained with a simple construction using an elastic member, and special shape changes for realizing dust proofness or elastic material attaching members in the main body including the receptacles and the base become unnecessary. Thus, a cost increase is minimized and the shapes of the main body and the base are not limited.

DETAILED DESCRIPTION OF THE EXEMPLIFIED EMBODIMENTS

Exemplified embodiments of the invention will be described below in detail with reference to the accompanying drawings.

Figure 1:
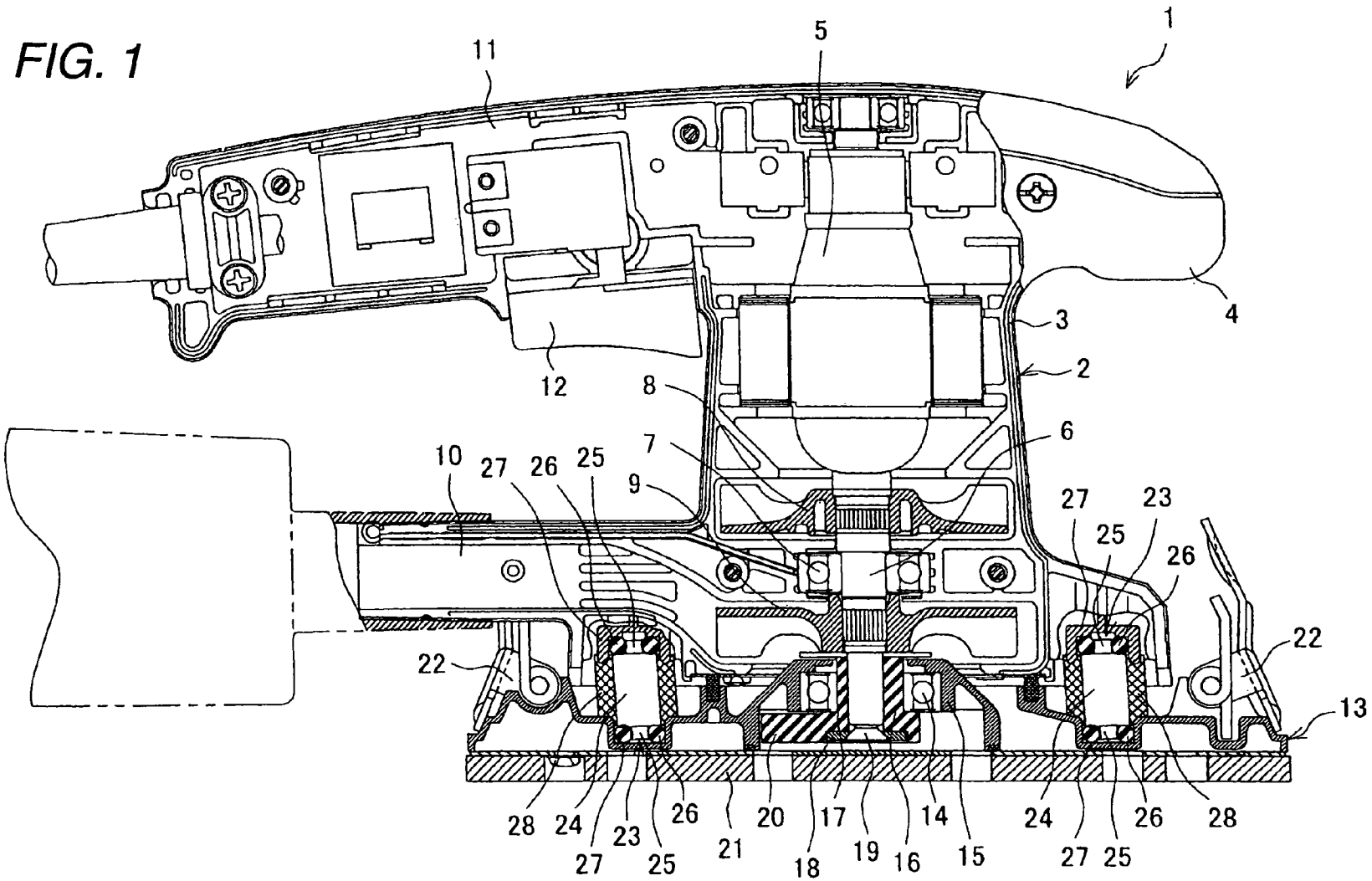
FIG. 1 is a vertical section view of a finishing sander according to a first embodiment of the invention.

FIG. 1 shows a finishing sander 1 according to a first embodiment of the invention. The finishing sander 1 includes a main body 2 and a base 13 provided below the main body. The main body 2 is formed by half-divided housings 3 and 4 adapted to be divided vertically into two pieces. A motor 5 is housed in the main body 2 such that an output shaft 6 thereof is directed downward. The output shaft 6 is axially supported by ball bearings 7 that projects to the lower side of the main body 2. A cooling fan 8 is orthogonally secured to the output shaft 6 above the ball bearings 7. A dust collecting fan 9 is orthogonally secured to the output shaft 6 below the ball bearings 7. The dust collecting fan 9 is operable to suck dust from the lower side of the main body 2 and to feed the dust to a dust collecting nozzle 10 provided in a side portion of the main body 2. The reference numeral 11 denotes a handle extended at the upper side of the main body 2, and the reference numeral 12 denotes a switch lever.

On the other hand, at the center of the base 13, a bearing box 15 for housing ball bearings 14 is formed, and by inserting the output shaft 6 of the motor 5 into an eccentric hole 17 of an eccentric sleeve 16 axially supported by the ball bearings 14 the output shaft 6 at an eccentric position via an eccentric sleeve 16 is axially supported. The reference numerals 18 and 19 are a flat washer and a flat head screw as a stopper for the eccentric sleeve 16, and the reference numeral 20 denotes a balancer projected from an eccentric side of the eccentric sleeve 15.

The reference numeral 21 is a pad provided on the lower surface of the base 13, and on its front and rear sides, clampers 22 are provided, respectively, and on the bottom surface of the pad 21, a sanding paper that is not shown can be stretched thereon.

The reference numerals 23 denote feet laid between the main body 2 and the base 13 and include foot bodies 24 that have columnar shapes and are made of aluminum and rubber O-rings 26, respectively. Herein, in a state that the O-rings 26 are housed in the receptacles 27 recessed in the main body 2 and the base 13, respectively, so as to face each other, the O-rings are externally fitted to small diameter portions 25 projected from the centers of both ends of the foot bodies 24, whereby the O-rings 26 are pressurized to elastically support the foot bodies 24 in the axial direction thereof. The small diameter portions 25 have length that does not exceed the outermost ends of the O-rings 26 in the axial direction thereof, respectively.

In this embodiment, sponge sleeves 28 serving as elastic members are fitted onto the outer peripheries of the foot bodies 24, respectively. The sponge sleeve 28 is a cylindrical member slightly longer in the axial direction than the vertical interval between the upper and lower receptacles 27. In a state that the sponge sleeve 28 is fitted onto the outer periphery of the foot body 24, the upper and lower ends come into pressure contact with the opening edges of the receptacles 27, respectively, and deform according to the opening edge shapes, whereby closing a gap between the receptacles 27.

In the finishing sander 1 constructed as described above, when the switch lever 12 is pushed down to drive the motor 5, the output shaft 6 rotates, however, the ball bearings 14 on the base 13 side axially support the output shaft 6 at an eccentric position via the eccentric sleeve 16, so that according to rotation of the output shaft 6, the base 13 makes orbital motion (eccentric motion) around the center of axis of the output shaft 6. Due to this orbital motion of the base 13, it becomes possible to sand an object material with a sanding paper stretched on the bottom surface of the base 13.

According to the orbital motion, the foot 23 makes so-called precession in that the lower end held by the receptacle 27 on the base 13 side makes a circular motion following the base 13 around a pivot set on the upper end held by the receptacle 27 on the main body 2 side, and acts to restrict rotation of the base 13 itself and prevent vertical vibration of the base 13.

Since the sponge sleeve 28 is fitted onto the outer periphery of the foot 23 so as to close a gap between the receptacles 27, there is no possibility that dust caused by sanding enters the inside of the receptacles 27 from the portions between the foot body 24 and the receptacles 27. Particularly, since the sponge sleeve 28 is elastic, even when the foot 23 makes precession, the contact portion with the receptacle 27 deforms following the receptacle 27 and a closely-fitted state is maintained. In addition, even when the sponge sleeve 28 is fitted onto the outer periphery of each foot 23, its resistance against the base 13 making orbital motion is very small, so that it does not influence the sanding performance of the finishing sander 1 itself.

Herein, since the foot body 24 is comprised of aluminum, it is high in rigidity and can effectively prevent vertical flopping of the base 13, and also brings about a heat radiation effect. In addition, since both ends of the foot body 24 are elastically supported by the O-rings 26, both ends of the foot body 24 become free ends and smoothly make precession. Furthermore, since only a compression force acts on the O-ring 26 itself, and no shearing force or bending force is applied thereto, wearing is reduced. That is, the vibration isolating effect for the base 13 can be improved by effectively opposing this to axial vibration, and this contributes to the realization of smooth orbital motion of the base 13.

Thus, according to the finishing sander 1 of the first embodiment, by fitting a sponge sleeve 28 onto the outer periphery of the foot body 24 so as to cover the exposed portion of the foot body 24 and by bringing the upper and lower ends thereof into pressure contact with opening edges of the receptacles 27 so as to close a gap between the receptacles 27, high dust proofness is attained in each foot 23. Therefore, the foot bodies 24, the O-rings 26, and the receptacles 27 are prevented from being worn by dust. In addition, the above effect can be attained with the simple construction in which the sponge sleeve 28 is fitted onto the outer periphery of each foot 23, and special shape change for securing dust proofness or members for attaching the sponge sleeve 28 become unnecessary on the main body 2 and the base 13 including the receptacles. Therefore, a cost increase is minimized, and the shapes of the main body 2 and the base 13 are not limited.

Next, a second embodiment of the invention will be described with reference to FIG. 2. Components similar to those in the first embodiment will be designated by the same reference numerals and repetitive explanations for those will be omitted.

Figure 2:
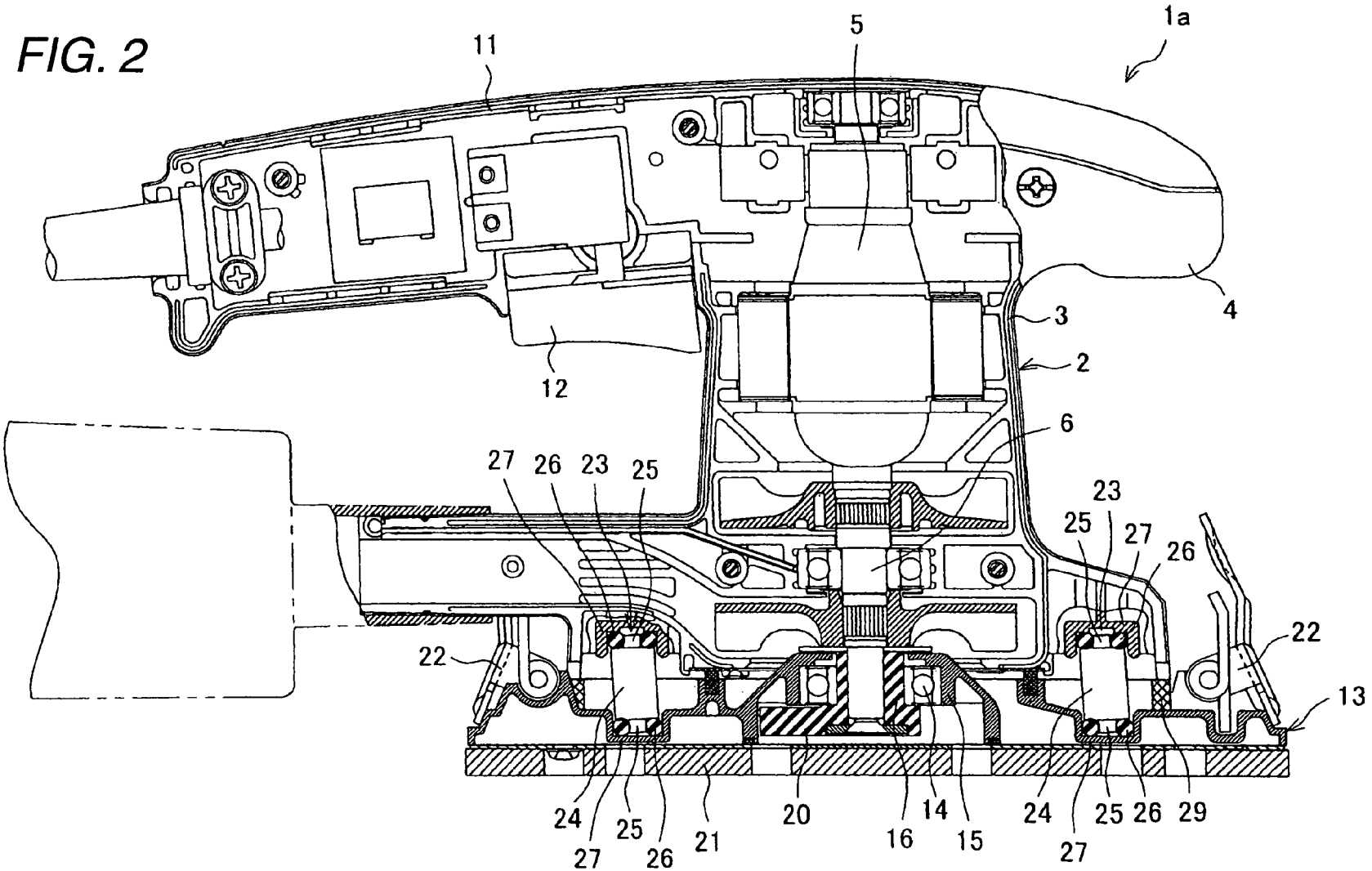
FIG. 2 is a vertical section view of a finishing sander according to a second embodiment of the invention.

In the finishing sander 1*a* shown in FIG. 2, a sponge sleeve 29 is not fitted onto the outer periphery of each foot 23, but is interposed between the main body 2 and the base 13 so as to surround the entire region in which the feet 23 are provided. That is, the sponge sleeve 29 is a large cylindrical member formed along the outer contour of the lower surface of the main body 2. The sponge sleeve 29 is slightly longer in the axial direction than the vertical interval between the main body 2 and the base 13, and the upper end is brought into pressure contact with the lower surface of the main body 2, and the lower end is brought into pressure contact with and closely fitted to the upper surface of the base 13 on the inner side than the clamper 22, whereby closing the entire region including the feet 23.

Therefore, in this finishing sander 1*a*, since the entire region including the feet 23 between the main body 2 and the base 13 is covered by the sponge sleeve 29, there is no possibility that dust caused by sanding enters the insides of the receptacles 27 from the portions between the foot bodies 24 and the receptacles 27. Also in this embodiment, since the sponge sleeve 29 is elastic, even when the base 13 makes orbital motion, the portion of the sponge sleeve 29 in contact with the base 13 deforms following this, so that the closely-fitted state is maintained.

According to the finishing sander 1*a* of the second embodiment, by interposing a sponge sleeve 29 between the main body 2 and the base 13 so as to cover the entire region including the feet 23, the entire region including the feet 23 is closed by bringing its upper end into pressure contact with the main body 2 and its lower end into pressure contact with the base 13, respectively. Thus, high dust proofness is attained in each foot 23, and the foot bodies 24, the O-rings 26, and the receptacles 27 are prevented from being worn by dust. In addition, this effect can be attained with a simple construction in which a single sponge sleeve 29 is interposed between the main body 2 and the base 13, and special shape change for dust-proofing or attaching members for the sponge sleeve 29 become unnecessary on the main body 2 and the base 13. Therefore, a cost increase is minimized, and the shapes of the main body 2 and the base 13 are not limited.

As a common variation of the first and second embodiments, the elastic member is not limited to a sponge, and other materials such as a synthetic resin and felt can also be used. Depending on the material, it is also possible that the thickness of the central portion is made thinner than the upper and lower ends to secure the followability to the orbital motion, or sleeves which have different diameters from one another and made from different materials from one another are coaxially overlapped with each other to form a multiple cylinder to increase the dust proofness.

Furthermore, the sponge sleeves 28 and the sponge sleeve 29 can be adopted at the same time, so that higher dust proofness can be obtained.

In addition, the axially supporting structure of the foot body on the receptacles is not limited to the above-described embodiments, but can be changed in design as appropriate as long as the foot body can be elastically supported in the axial direction thereof, such that the foot body is held by an angular ring with a quadrilateral sectional shape or a plurality of balls instead of the O-ring, the small diameter portions are omitted and the entire ends are held by flat rubber instead, or rubbery ball or plates are interposed between the end portions of the foot body and the receptacle bottom surface. Instead of using the same axial supporting structure at the upper side and the lower side of the foot body, mutually different structures may be used between the upper and lower sides such that the lower end with a larger motion amount is received by an O-ring and the upper end is supported by the ball or plate.

Furthermore, the foot body may be made of a metal other than aluminum, however, the use of aluminum is preferable since it realizes a light weight, predetermined rigidity and heat radiation effect.

Although only some exemplary embodiments of the invention have been described in detail above, those skilled in the art will readily appreciated that many modifications are possible in the exemplary embodiments without materially departing from the novel teachings and advantages of the invention. Accordingly, all such modifications are intended to be included within the scope of the invention.

The disclosure of Japanese Patent Application No. 2006-236079 filed Aug. 31, 2006 including specification, drawings and claims is incorporated herein by reference in its entirety.

What is claimed is:

1. A sander, comprising:

a main body;

a motor, disposed in the main body and having a rotary shaft;

a base, disposed below the main body, the base being coupled to the rotary shaft and adapted to make eccentric motions in accordance with rotations of the rotary shaft;

a first receptacle disposed in the main body;

a second receptacle disposed in the base;

a foot, disposed between the first receptacle and the second receptacle, and comprising:

a foot body having opposite ends and comprised of metal; and elastic members, provided on the opposite ends of the foot body and respectively fitted into the first receptacle and the second receptacle, so that the foot body is pivotably supported between the first receptacle and the second receptacle; and an elastic sleeve, fitted onto a part of an outer periphery of the foot body while being compressed by the first receptacle and the second receptacle.

2. The sander as set forth in claim 1, wherein:

the elastic sleeve has a length longer than an interval between a lower edge of the first receptacle and an upper edge of the second receptacle; and an upper edge of the elastic sleeve is in press contact with the lower edge of the first receptacle, and a lower edge of the elastic sleeve is in press contact with the upper edge of the second receptacle.

3. The sander as set forth in claim 1, wherein:

the elastic sleeve is comprised of sponge.

4. The sander as set forth in claim 1, wherein:

the foot body is comprised of aluminum.

5. A sander, comprising:

a main body;

a motor, disposed in the main body and having a rotary shaft;

a base, disposed below the main body, the base being coupled to the rotary shaft and adapted to make eccentric motions in accordance with rotations of the rotary shaft;

a first receptacle disposed in the main body;

a second receptacle disposed in the base;

a foot, disposed between the first receptacle and the second receptacle, and comprising:

a foot body having opposite ends and comprised of metal; and elastic members, provided on the opposite ends of the foot body and respectively fitted into the first receptacle and the second receptacle, so that the foot body is pivotably supported between the first receptacle and the second receptacle; and an elastic sleeve, surrounding a region in which the foot is provided, while being compressed by a lower surface of the main body and an upper surface of the base.

6. The sander as set forth in claim 5, wherein:

the elastic sleeve has a length longer than an interval between the lower surface of the main body and the upper surface of the base; and an upper edge of the elastic sleeve is in press contact with the lower surface of the main body, and a lower edge of the elastic sleeve is in press contact with the upper surface of the base.

7. The sander as set forth in claim 5, wherein:

the elastic sleeve is comprised of sponge.

8. The sander as set forth in claim 5, wherein:

the foot body is comprised of aluminum.

* * * * *